US006565329B2

(12) United States Patent
Yokomachi et al.

(10) Patent No.: US 6,565,329 B2
(45) Date of Patent: May 20, 2003

(54) ELECTRIC TYPE SWASH PLATE COMPRESSOR

(75) Inventors: Naoya Yokomachi, Kariya (JP); Kazuo Murakami, Kariya (JP); Yoshiyuki Nakane, Kariya (JP); Susumu Tarao, Kariya (JP)

(73) Assignee: Kabushiki Kaisha Toyoda Jidoshokki Seisakusho, Kariya (JP)

( * ) Notice: Subject to any disclaimer, the term of this patent is extended or adjusted under 35 U.S.C. 154(b) by 0 days.

(21) Appl. No.: 09/758,578

(22) Filed: Jan. 10, 2001

(65) Prior Publication Data

US 2001/0007635 A1 Jul. 12, 2001

(30) Foreign Application Priority Data

Jan. 11, 2000 (JP) ..... 2000-002969

(51) Int. Cl.[7] ..... F04B 1/12; F04B 27/08

(52) U.S. Cl. ..... 417/269; 417/271; 417/366; 417/372

(58) Field of Search ..... 417/269, 366, 417/369, 372, 391, 357, 271, 415, 269.271, 366.367, 368.369, 357.391, 371.372

(56) References Cited

U.S. PATENT DOCUMENTS

| | | | | | |
|---|---|---|---|---|---|
| 3,295,457 | A | * | 1/1967 | Oram | 103/118 |
| 3,934,967 | A | | 1/1976 | Gannaway | 417/271 |
| 4,388,808 | A | * | 6/1983 | Durence | 62/6 |
| 4,516,913 | A | * | 5/1985 | Girodin | 417/243 |
| 4,743,176 | A | * | 5/1988 | Fry | 417/368 |
| 4,850,812 | A | * | 7/1989 | Voight | 417/271 |
| 4,850,816 | A | * | 7/1989 | Voight | 417/271 |
| 4,995,791 | A | | 2/1991 | Loprete | 417/366 |
| 5,877,577 | A | * | 3/1999 | Ishizaki et al. | 310/261 |
| 5,893,706 | A | * | 4/1999 | Kawaguchi et al. | 417/373 |
| 5,971,717 | A | * | 10/1999 | Berthold | 417/269 |
| 5,987,886 | A | * | 11/1999 | Sekiya et al. | 60/523 |
| 6,247,899 | B1 | * | 6/2001 | Ban et al. | 417/16 |

FOREIGN PATENT DOCUMENTS

| | | | |
|---|---|---|---|
| EP | 0 942 169 A2 | 9/1999 | F04B/27/18 |
| JP | 01-167474 | 7/1989 | F04B/39/06 |
| JP | 5-187356 | 7/1993 | F04B/27/08 |
| JP | 5-256285 | 10/1993 | F04C/23/00 |
| JP | 7-133779 | 5/1995 | F04C/29/00 |
| JP | 09-032729 | 2/1997 | F04B/39/06 |
| JP | 9-236092 | 9/1997 | F04C/29/04 |

* cited by examiner

*Primary Examiner*—Charles G. Freay
*Assistant Examiner*—Han L. Lin
(74) *Attorney, Agent, or Firm*—Morgan & Finnegan, LLP

(57) ABSTRACT

The object of the present invention is to offer an electric type swash plate compressor which is compact and reduced in weight and lightened, and which can efficiently cool down a motor chamber and a crank chamber.

The compressor has an electric motor and a swash plate, which are respectively accommodated in the motor chamber and the crank chamber. In the compressor a communication route, which communicates a part except the discharge chamber communicating with an external refrigerant circuit in an inner refrigerant circuit within an outer casing with the motor chamber, is formed. The communication route is formed so as to pass through the crank chamber, and the refrigerant in lower temperature and lower pressure than discharge refrigerant is supplied into the motor chamber and the crank chamber. Accordingly, the improvement of cooling efficiency and the reduction of pressure resisting strength of the casing can be performed.

13 Claims, 7 Drawing Sheets

ELECTRIC TYPE SWASH PLATE COMPRESSOR

BACKGROUND OF THE INVENTION

The present invention relates to an electric type swash plate compressor for use in a vehicle air conditioner and the like.

An electric compressor is known as a compressor included in a refrigerant circulation circuit of a heat exchanger such as the vehicle air conditioner. In general, the electric compressor has an electric motor and a compression mechanism to compress refrigerant driven by the motor within an outer casing of the compressor. The compression mechanism is composed of pistons accommodated so as to reciprocate in cylinder bores in the compressor, and of a swash plate, which is located in a crank chamber defined in the compressor and converts rotating movement of the motor to reciprocating movement of the pistons. As for the motor, capacity to rotate at a high speed and a driving force to endure a high load torque are expected. So, the compressor needs to have a powerful motor. In the arrangement of the powerful motor against a high load for rotation, however, the temperature around the motor rises since the motor generates heat. The rise in the temperature around the motor heats the motor further, and that makes magnetic force of the motor decrease, and the compressor involves the risk that rotating efficiency of the motor falls. Therefore, it needs to cool down the motor to prevent the motor from rising in temperature.

When the swash plate rotates at a high speed, its temperature rises because of a sliding friction with a pair of shoes placed between the swash plate and the piston. Therefore, it also needs to cool down the swash plate to improve durability and sliding stability thereof.

As an arrangement to cool down the motor, Japanese Unexamined Patent Publication No. 7-133779 is known. In the arrangement, the discharged refrigerant from the compression mechanism, which is sent to the device downstream to the compressor, such as a condenser, is introduced into a motor chamber, and is used to cool down the motor.

In addition, Japanese Unexamined Patent Publication No. 9-236092 discloses the following arrangement. The refrigerant which is drawn into the compressor from the device upstream to the compressor, such as an evaporator, is used to cool down the motor.

However, in the former arrangement, the discharged refrigerant used to cool the motor is high in pressure and in temperature since the refrigerant is compressed. Therefore, the following two problems are caused when the refrigerant in the above state is used to cool down the motor.

First, the discharged refrigerant in high pressure prevents the casing from making it compact and reducing its weight. That is, the motor chamber occupies a large space in the compressor, and it needs to improve the strength of the casing, such as an increase of the thickness of the casing, an increase of reinforcement and the thickness inside the casing, so that the casing can resist high pressure.

Second, the refrigerant used to cool down the motor in itself is high in temperature, so the motor is not efficiently cooled down.

In the meantime, both publications do not disclose that the refrigerant cools down the swash plate, but only disclose that the refrigerant is introduced into the motor chamber to cool down the motor. That is, it is not considered to cope with overheat of the swash plate under the present conditions.

SUMMARY OF THE INVENTION

The object of the present invention is to offer an electric type swash plate compressor which can be not only compact and reduced in weight but also efficiently cool down a motor chamber and a crank chamber.

To solve the above problems, the present invention has following features. The compressor has a motor chamber, a crank chamber and cylinder bores formed within an outer casing, and pistons accommodated in the cylinder bores so as to be reciprocated, and a drive shaft extended in the motor chamber and the crank chamber so as to be rotatably supported in the casing, connected to an electric motor in the motor chamber and reciprocating the pistons through the swash plate connected to the drive shaft in the crank chamber. A communication route, which introduces a refrigerant in lower temperature than a refrigerant in a discharge chamber into the motor chamber formed in an inner refrigerant circuit in the casing passes through the crank chamber.

According to the present invention, the motor chamber and the crank chamber of the electric type swash plate compressor are cooled down when the refrigerant in the inner refrigerant circuit in the casing is introduced through the communication route. The refrigerant introduced into both chambers is lower in temperature and in pressure than the refrigerant in the discharge chamber communicating with the external refrigerant circuit, or the discharge refrigerant. So, it can reduce temperature and pressure more in both chambers than the arrangement that the discharge refrigerant is used to cool down the chambers. That is, the cooling efficiency can be improved and moreover, the pressure resisting strength of the casing can be reduced.

Furthermore, the present invention has following features. The compressor is a multistage type having a first cylinder bore, where the refrigerant drawn from the external refrigerant circuit is compressed, and a second cylinder bore, where the refrigerant in intermediate pressure, at least once being compressed, is drawn and compressed. The communication route communicates an intermediate pressure chamber having the refrigerant in intermediate pressure with the motor chamber.

According to the present invention, the motor chamber and the crank chamber are cooled down by the refrigerant in the intermediate pressure discharged into the intermediate pressure chamber of the multistage compressor. Since the refrigerant in the intermediate pressure is much lower in temperature and in pressure than the discharge refrigerant, it is suitable for the improvement of the cooling efficiency and the reduction of the pressure resisting strength of the casing.

Furthermore, the present invention has following features. The motor chamber is arranged upstream to the crank chamber in the communication route, and at least a part of the refrigerant is introduced into the crank chamber through the motor chamber.

According to the present invention, before the crank chamber is cooled down, the motor chamber is cooled down. That is, the refrigerant in low temperature of which temperature does not rise in the crank chamber at least cools down the motor chamber, so the cooling efficiency of the motor chamber is further improved.

Furthermore, the present invention has following features. The communication route communicates either of the suction chamber having the refrigerant drawn from the external refrigerant circuit and the intake port introducing the refrigerant into the suction chamber with the motor chamber.

According to the present invention, the refrigerant drawn from the external refrigerant circuit is introduced into the motor chamber and the crank chamber. The refrigerant is still lower in temperature and in pressure than the refrigerant in intermediate pressure. Accordingly, the present invention is further suitable for the improvement of the cooling efficiency and the reduction of the pressure resisting strength of the casing.

Furthermore, the present invention has following features. The branch communicating passage, which is branched from the suction chamber or the intake port, constitutes the inner refrigerant circuit in the casing of the compressor and is arranged upstream to the motor chamber and the crank chamber.

According to the present invention, the suction refrigerant is introduced into the motor chamber and the crank chamber through the branch communicating passage. At that time some part of the suction refrigerant is introduced into both chambers, while the other part of the refrigerant is not introduced into both chambers but is drawn into the cylinder bores. Accordingly, the suction refrigerant, of which temperature highly rises in both chambers, occupies only a part of the refrigerant, so the refrigerant drawn into the cylinder bores does not rise in temperature relatively. That is, the fall of the compressive efficiency, which is caused by the increase of the specific volume by a rise of the refrigerant in temperature drawn into the cylinder bores, can be prevented.

BRIEF DESCRIPTION OF THE DRAWINGS

The features of the present invention that are believed to be novel are set forth with particularity in the appended claims. The invention together with objects and advantages thereof, may best be understood by reference to the following description of the presently preferred embodiments together with the accompanying drawings in which:

DETAILED DESCRIPTION OF THE PREFERRED EMBODIMENTS

Embodiment 1

A first embodiment of a multistage electric type swash plate compressor which uses carbon dioxide as a refrigerant according to the present invention will now be described in FIG. 1 and FIG. 2. The left side of FIG. 1 is the front of the compressor, and the right side of FIG. 1 is the rear of it.

Figure 1:
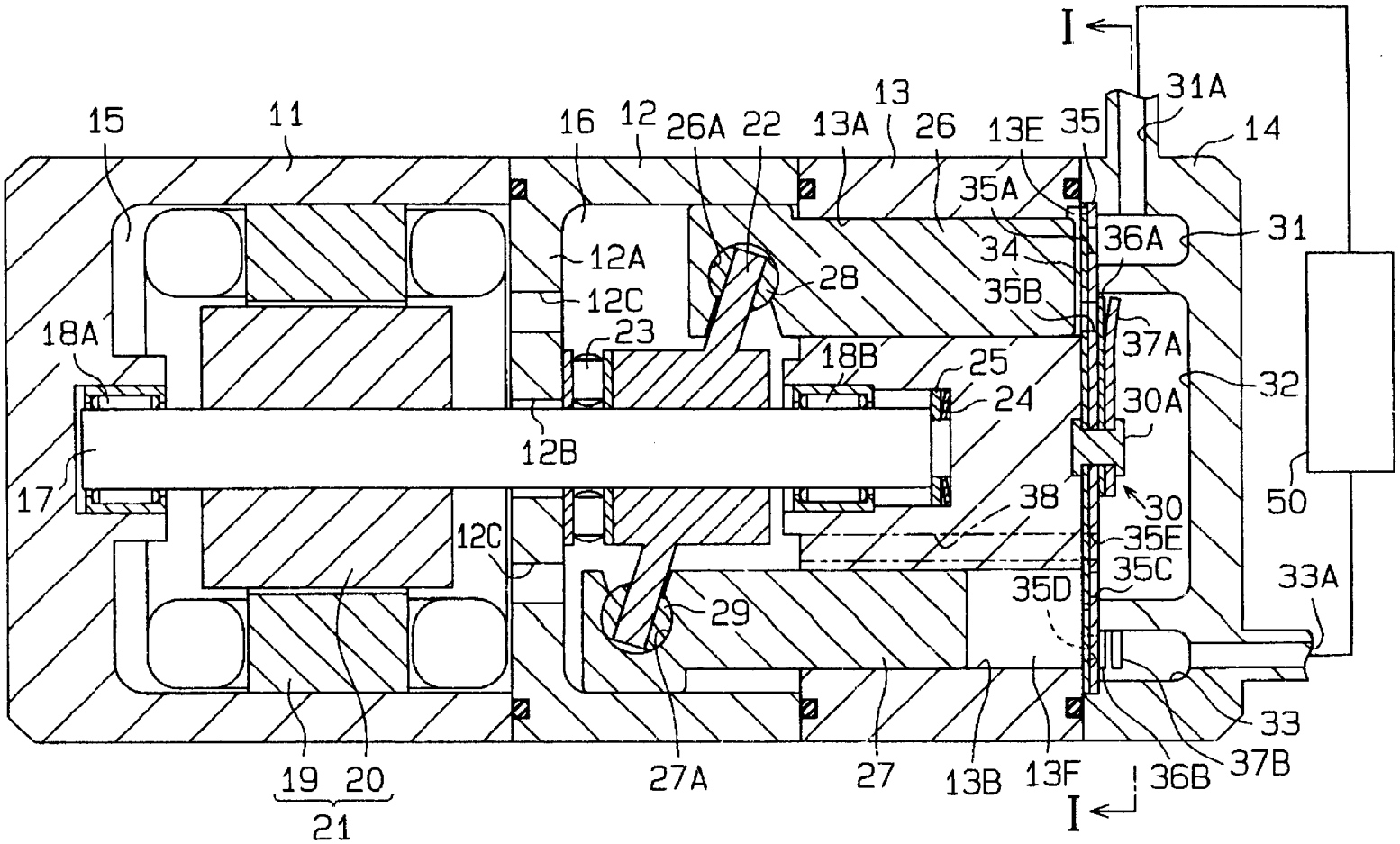
FIG. 1 is a cross-sectional view illustrating an electric type swash plate compressor according to a first embodiment of the present invention.
Figure 2:
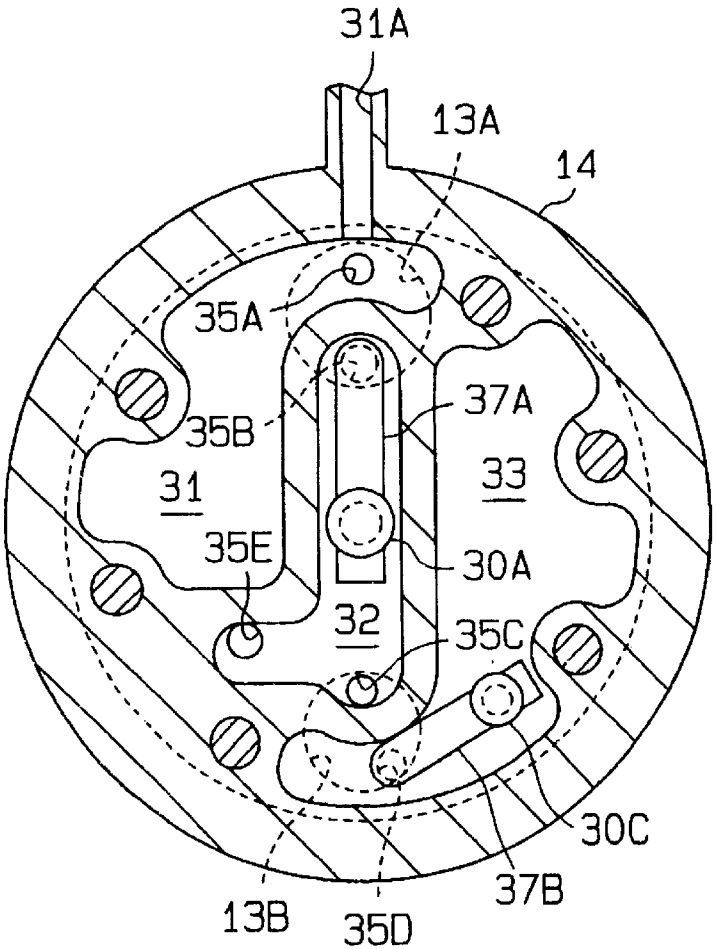
FIG. 2 is a cross-sectional view as seen from line I—I in FIG. 1.

As shown in FIG. 1, the electric type swash plate compressor has a motor housing 11, a front housing 12, a cylinder block 13 and a rear housing 14. Each of the housings 11, 12 and 14, and the cylinder block 13 are secured each other with through bolts which are not illustrated, and constitute an outer casing of the compressor almost in a cylindrical shape. A motor chamber 15 is defined in a region surrounded by the motor housing 11 and the front housing 12. A crank chamber 16 is defined in a region surrounded by the front housing 12 and the cylinder block 13.

A drive shaft 17, which is inserted into the motor chamber 15 and the crank chamber 16, is rotatably supported through front and rear radial bearings 18A and 18B, between the motor housing 11 and the cylinder block 13. The drive shaft 17 is loosely inserted into a central bore 12B of a front wall 12A formed in the front housing 12.

In the motor chamber 15 an electric motor 21 composed of a stator 19 and a rotor 20, is accommodated. The rotor 20 is integrally and rotatably fixed on the drive shaft 17.

In the crank chamber 16 a swash plate 22 in a disk shape is integrally and rotatably fixed on the drive shaft 17, and a thrust bearing 23 is mounted between the swash plate 22 and the front wall 12A. The drive shaft 17 and the swash plate 22 is positioned in the thrust direction (in the direction of axis of the drive shaft) by the thrust bearing 23 and a washer 25, which is urged forward by a spring 24 placed in a recess formed in the center of the cylinder block 13.

In the cylinder block 13 the first cylinder bore 13A and the second cylinder bore 13B, which is another cylinder bore having smaller radius than the cylinder bore 13A, are formed in an opposite position with respect to the drive shaft 17 each other. A single head type first piston 26 and second piston 27 are respectively accommodated so as to reciprocate back and forth slidably in each of the cylinder bores 13A and 13B. Compression chambers 13E and 13F which change each volume in accordance with reciprocating movement of each pistons 26 and 27 are respectively defined in each cylinder bores 13A and 13B. In the front part of each pistons 26 and 27, concave portions 26A and 27A are respectively formed, and pair of shoes 28 and 29 are respectively accommodated therein. Circumferetial portion of the swash plate 22 is slidably sandwiched by shoes 28 and 29, so each of the pistons 26 and 27 is operably connected to the swash plate 22. Therefore, the rotational movement of the swash plate 22 is converted into liner reciprocating movements of the pistons 26 and 27 with the strokes in accordance with the inclination angle of the swash plate 22 when the swash plate 22 rotates synchronously with the drive shaft 17, which is rotated by the electric motor 21.

A valve plate assembly 30 is sandwiched between the cylinder block 13 and the rear housing 14. As shown in FIGS. 1 and 2, a suction chamber 31, where the refrigerant drawn from the external refrigerant circuit 50 is introduced through the intake port 31A formed in the circumferential wall of the rear housing 14, is formed between the valve plate assembly 30 and the rear housing 14. An intermediate pressure chamber 32 connecting the cylinder bore 13A to the cylinder bore 13B, in which pressure is intermediate between the suction pressure introduced into the compressor and the discharge pressure discharged from the compressor, by having been compressed at least once, and the discharge chamber 33 communicating with the external refrigerant circuit 50 through the outlet port 33A formed in the rear wall of the rear housing 14, are defined.

In the valve plate 35, ports 35A, 35B, 35C, 35D and 35E are formed. The port 35A communicates the suction chamber 31 with the first cylinder bore 13A, and the port 35B communicates the first cylinder bore 13A with the intermediate pressure chamber 32. The port 35C communicates the second cylinder bore 13B with the intermediate pressure chamber 32, and the port 35D communicates the second cylinder bore 13B with the discharge chamber 33. The port 35E communicates the intermediate pressure chamber 32 with the crank chamber 16 through a communication passage 38 as mentioned later.

On the suction valve disk 34, suction valves are formed in position corresponding to the ports 35A and 35C. The discharge valve 36A and the retainer 37A are fixed to the suction valve disk 34 and the valve plate 35 by the pin 30A in the intermediate pressure chamber 32. As shown in FIG. 2, in the discharge chamber 33 the discharge valve 36B and the retainer 37B are fixed to both the suction valve disk 34 and the valve plate 35 by the pin 30C.

An inner refrigerant circuit in the compressor comprises the intake port 31A, the suction chamber 31, the port 35A, the first cylinder bore 13A, the port 35B, the intermediate pressure chamber 32, the port 35C, the second cylinder bore 13B, the port 35D, the discharge chamber 33 and the outlet port 33A.

In the cylinder block 13, the communication passage 38 communicating the intermediate pressure chamber 32 with the crank chamber 16 is formed. In the front wall 12A of the front housing 12, the communication bore 12C communicating the crank chamber 16 with the motor chamber 15 is formed. The communication passage 38, the crank chamber 16, the central bore 12B of the front housing 12 and the communication bore 12C constitute a communication route communicating the intermediate pressure chamber 32 with the motor chamber 15.

Next, the operation of the above compressor is described.

When the drive shaft 17 is rotated by the electric motor 21, the swash plate 22 integrally rotates with the drive shaft 17. The pistons 26 and 27 are reciprocated respectively through shoes 28 and 29 by the rotational movement of the swash plate 22. In each of the compression chambers 13E and 13F, the processes of drawing, compressing and discharging the refrigerant are repeated in turn.

The refrigerant drawn from the intake port 31A to the suction chamber 31 is drawn into the compression chamber 13E through the port 35A, and the refrigerant is compressed by the rearward movement of the piston 26. Then the refrigerant is discharged into the intermediate pressure chamber 32 through the port 35B.

A part of the refrigerant in the intermediate pressure chamber 32 is drawn into the compression chamber 13F through the port 35C, and the refrigerant is compressed by the second piston 27. Then the refrigerant is discharged into the discharge chamber 33 through the port 35D. The refrigerant discharged into the discharge chamber 33 is sent out to the external refrigerant circuit 50 through the outlet port 33A.

On the other hand, at least a part of the refrigerant in the intermediate pressure chamber 32, which is not drawn into the compression chamber 13F, is supplied into the crank chamber 16 through the port 35E and the communication passage 38. Then the refrigerant is supplied into the motor chamber 15 from the crank chamber 16 through the thrust bearing 23, the central bore 12B of the front housing 12 and the communication bore 12C. The refrigerant is effectively supplied into the motor chamber 15 or the crank chamber 16 by stir of rotation of the rotor 20 and the swash plate 22 by rotation of the electric motor 21. Therefore, the electric motor 21 is cooled down by the refrigerant supplied into the motor chamber 15, and the swash plate 22, the shoes 28, 29 and the like are cooled down by the refrigerant supplied into the crank chamber 16.

The refrigerant in the intermediate pressure chamber 32 is much lower in temperature and in pressure than the refrigerant in the discharge chamber 33 compressed in both the compression chambers 13E and 13F, since the refrigerant in the intermediate pressure chamber 32 is compressed only in the compression chamber 13E.

In the embodiment the following effects can be obtained.

(1) The refrigerant in the intermediate pressure chamber 32, which is much lower in pressure than the refrigerant in the discharge chamber 33, is introduced to cool down the motor chamber 15 and the crank chamber 16. Therefore, the motor chamber 15 and the crank chamber 16 are not as high in pressure as the refrigerant in the discharge chamber 33, and strength to resist the pressure of the portions corresponding to the motor chamber 15 and the crank chamber 16 in the casing can be lowered. Accordingly, compactness and improvement of durability of the casing can be performed. Since the refrigerant in the intermediate pressure chamber 32 is much lower in temperature than the refrigerant in the discharge chamber 33, the motor chamber 15 is efficiently cooled down. As a result, even when the compressor is driven at a high speed and the motor 21 is applied a large load, the motor 21 is prevented from decreasing the magnetic force.

(2) The refrigerant in the intermediate pressure chamber 32 is introduced into not only the motor chamber 15 but also the crank chamber 16. That is, inside of the casing of the compressor is cooled down in wide range. Accordingly, the shoes 28 and 29 can be prevented from overheating when the compressor is driven at a high speed and the motor 21 is applied a large load.

(3) Since the refrigerant in the intermediate pressure chamber 32 is introduced into the crank chamber 16, the bearings 18B and 23, the swash plate 22, the shoes 28 and 29, the pistons 26 and 27, and the lubricating oil, which is contained in the carbon dioxide in the state of the mist, can be efficiently cooled down. That is, the deterioration of the lubricating oil caused by slide of each members such as the bearings 18B and 23, the swash plate 22, the shoes 28 and 29, and the pistons 26 and 27, which are in high temperature, and the deterioration of the lubricating oil in high temperature can be prevented.

Moreover, since the refrigerant in the intermediate pressure chamber 32 is introduced into the crank chamber 16, the pressure in the crank chamber 16 becomes the same as the pressure in the intermediate pressure chamber 32. That is, the pressure acting on the front end of the first piston 26 becomes nearly the same as the pressure acting on the rear end of the piston 26 when the refrigerant in the compression chamber 13E is discharged. The difference between the pressure acting on the front end of the second piston 27 and the pressure acting on the rear end of the piston 27 becomes also smaller than usual when the refrigerant in the compression chamber 13F is discharged. That is, since the difference in pressure between the front ends of the pistons 26 and 27 and the rear ends of the pistons 26 and 27 becomes small in the discharge process that the load acting on each of the pistons 26 and 27 is the largest, the forces acting on the swash plate 22, the shoes 28 and 29, and the pistons 26 and 27 become small. Accordingly, the deterioration of the lubricating oil caused by slide of large load between each of the members such as the swash plate 22, the shoes 28 and 29, and the pistons 26 and 27 can be prevented.

(4) The refrigerant in the intermediate pressure chamber 32 is already compressed in the compression chamber 13E and is higher in temperature than the refrigerant in the suction chamber 31. Therefore, the arrangement of the above embodiment that the refrigerant introduced from the intermediate pressure chamber 32 cools down the motor chamber 15 rises in temperature at a smaller rate than the arrangement that the refrigerant introduced from the suction chamber 31 is applied. That is, in the embodiment the compressive efficiency of the refrigerant is hardly lowered due to the increase of the specific volume.

Embodiment 2

Figure 3:
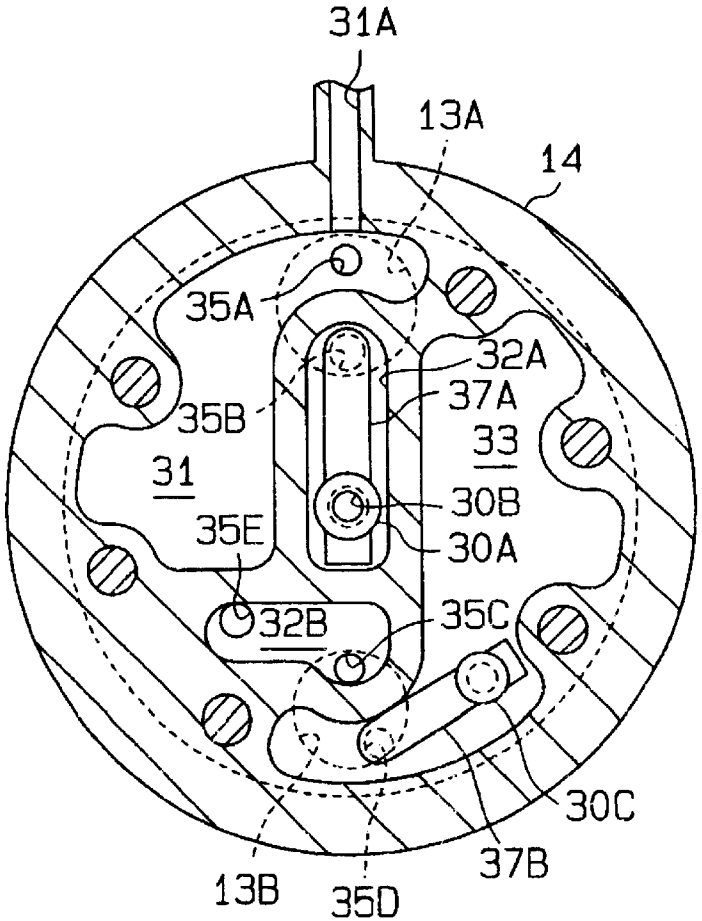
FIG. 3 is a cross-sectional view as seen from line II—II in FIG. 4.
Figure 4:
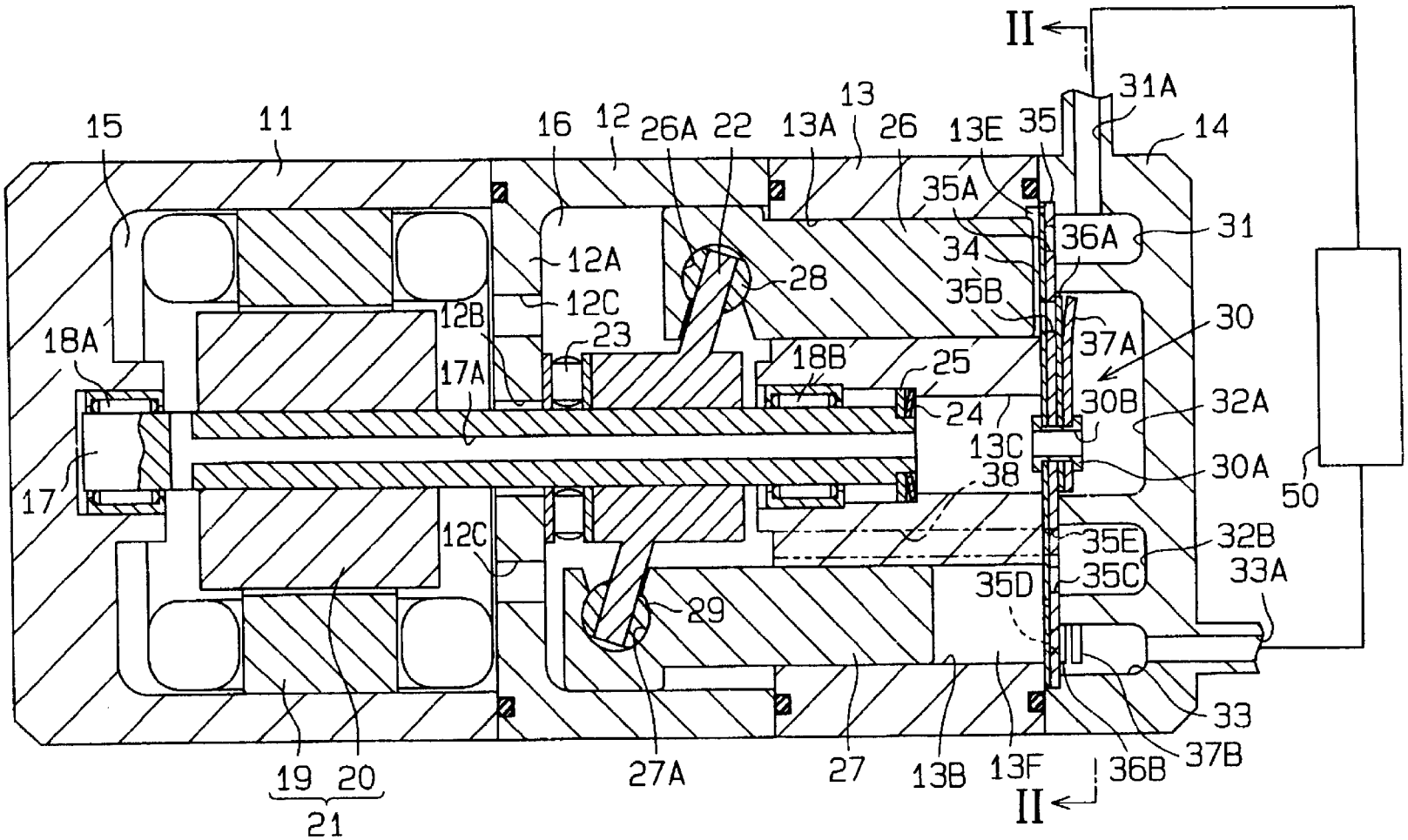
FIG. 4 is a cross-sectional view illustrating an electric type swash plate compressor according to a second embodiment of the present invention.

The electric type swash plate compressor according to the embodiment is shown in FIGS. 3 and 4. In this embodiment the arrangements of the refrigerant circuit and the communication route inside the casing according to the first embodiment are changed. In the other points, the embodiment is the same arrangement as the electric type swash plate compressor according to the first embodiment. Accordingly, the same reference numerals as the first embodiment are given to the components which are common to the first embodiment, and the overlapped description is omitted.

The suction chamber 31, the discharge chamber 33, and two intermediate pressure chambers 32A and 32B are defined between the valve plate assembly 30 and the rear housing 14. The first intermediate pressure chamber 32A communicates with the port 35B and a hole 30B, and the second intermediate pressure chamber 32B communicates with the ports 35C and 35E.

A hole 30B is formed so as to penetrate a pin 30A in the direction of the axis. In the cylinder block 13, a central bore 13C of the cylinder block 13 is formed so as to communicate the hole 30B and a recessed portion of the central bore 13C which accommodates the rear end of the drive shaft 17. A communication passage 17A in a drive shaft 17 is formed so that the front area in the motor chamber 15 communicates with the central bore 13C of the cylinder block 13. Besides, in the cylinder block 13 the communication passage 38 is formed so that the crank chamber 16 always communicates with the port 35E. Accordingly, a communication route is comprised of the hole 30B, the central bore 13C, the communication passage 17A, the central bore 12B, the communication bore 12C, the communication passage 38, the port 35E and the crank chamber 16 so that the intermediate pressure chambers 32A and 32B always communicate with each other through the motor chamber 15.

In addition to the communication route and the motor chamber 15, the intake port 31A, the suction chamber 31, the port 35A, the first cylinder bore 13A, the port 35B, the first and the second intermediate pressure chambers 32A and 32B, the port 35C, the second cylinder bore 13B, the port 35D, the discharge chamber 33 and the outlet port 33A constitute the inner refrigerant circuit inside of the casing.

The refrigerant, which is drawn from the suction chamber 31 to the first cylinder bore 13A and compressed, is discharged through the port 35B into the first intermediate pressure chamber 32A. The refrigerant in the first intermediate pressure chamber 32A is introduced into the front area in the motor chamber 15 through the hole 30B, the central bore 13C and the communication passage 17A. The refrigerant introduced into the motor chamber 15 passes a space between the stator 19 and the rotor 20, and is introduced into the crank chamber 16 through the communication bore 12C, the central bore 12B and the thrust bearing 23. Then the refrigerant in the crank chamber 16 is introduced into the second intermediate pressure chamber 32B through the communication passage 38.

The refrigerant in the second intermediate pressure chamber 32B is drawn into the second cylinder bore 13B through the port 35C, and is further compressed by the second piston 27, and is discharged into the external refrigerant circuit through the port 35D, the discharge chamber 33 and the outlet port 33A.

According to this embodiment, in addition to the effect of the first embodiment from (1) to (4), the following effect can be obtained.

(5) The motor chamber 15 and the crank chamber 16 are included in a single inner refrigerant circuit inside of the casing, which doesn't have another by-pass, so that the refrigerant inevitably passes through both chambers 15 and 16. Accordingly, the cooling effect of both chambers 15 and 16 is improved more than the first embodiment.

(6) The refrigerant in the first intermediate pressure chamber 32A is introduced into the motor chamber 15, and then into the crank chamber 16. That is, the refrigerant in the first intermediate pressure chamber 32A is directly introduced into the motor chamber 15 from the intermediate pressure chamber 32A before the crank chamber 16. Accordingly, since the refrigerant is low in temperature before the crank chamber 16, the motor chamber 15 can be efficiently cooled down.

(7) The compressor is arranged so that the refrigerant introduced into the front area of the motor chamber 15 reaches the rear area of the motor chamber 15 through the space between the stator 19 and the rotor 20. That is, the refrigerant cools down the surface of the electric motor 21 in wide range. Therefore, the electric motor 21 can be efficiently cooled down.

Embodiment 3

Figure 5:
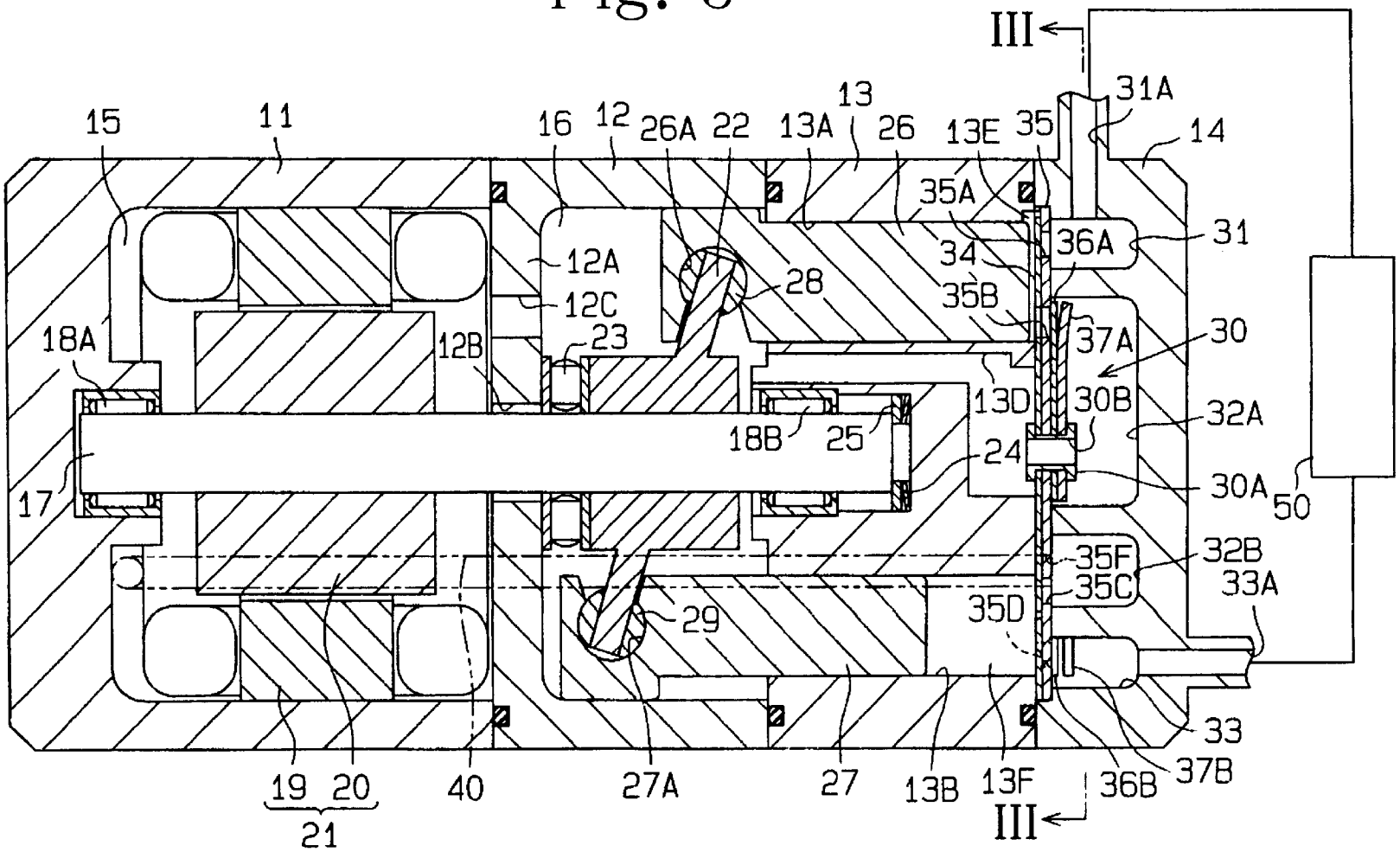
FIG. 5 is a cross-sectional view illustrating an electric type swash plate compressor according to a third embodiment of the present invention.
Figure 6:
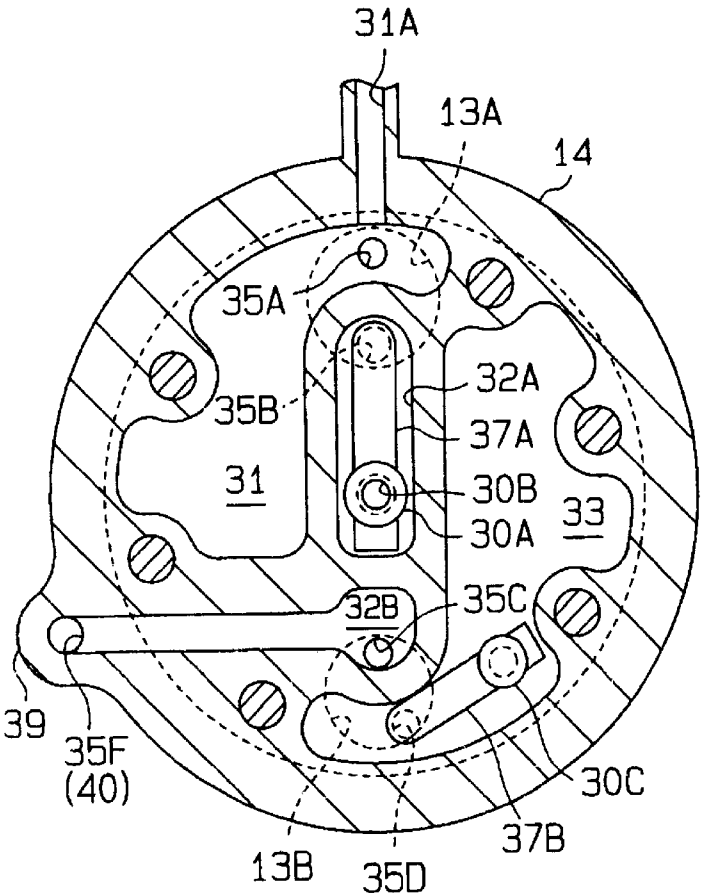
FIG. 6 is a cross-sectional view as seen from line III—III in FIG. 5.

The electric type swash plate compressor according to the embodiment is shown in FIGS. 5 and 6. In this embodiment the arrangements of the refrigerant circuit and the communication route inside of the casing according to the second embodiment are changed. In the other points, the compressor is the same arrangement as the electric type swash plate compressor according to the second embodiment. Accordingly, the same reference numerals as the second embodiment are given to the components which are common to the second embodiment, and the overlapped description is omitted.

As shown in FIG. 6, the second intermediate pressure chamber 32B is formed so as to extend near the outer circumferential portion of the rear housing 14. A communication passage 40, as a means for cooling down the refrigerant, is formed in a convex portion 39 which is protruded parallel to the drive shaft 17, at the outer circumferential surface of the casing of the compressor (the rear housing 14 in FIG. 6). The motor chamber 15 and the intermediate pressure chamber 32B communicate with each other through the communication passage 40 and the port 35F.

The communication passage 40 is penetrated across the motor housing 11, the front housing 12 and cylinder block 13, and always communicates between the port 35F and the front area of the motor chamber 15.

The communication bore 13D of the cylinder block 13, which communicates the crank chamber 16 with the hole 30B, is penetrated in the cylinder block 13. Accordingly, the hole 30B, the communication bore 13D, the central bore 12B, the communication bore 12C, the communication passage 40, the port 35F and the crank chamber 16 comprise the communication route which always communicates between the intermediate pressure chambers 32A and 32B through the motor chamber 15.

In addition to the communication route and the motor chamber 15, the intake port 31A, the suction chamber 31, the port 35A, the first cylinder bore 13A, the port 35B, the first and the second intermediate pressure chambers 32A and 32B, the port 35C, the second cylinder bore 13B, the port 35D, the discharge chamber 33 and the outlet port 33A constitute the refrigerant circuit inside of the casing.

In this embodiment the refrigerant in the first intermediate pressure chamber 32A is introduced into the crank chamber 16 through the hole 30B and the communication bore 13D of a cylinder block 13. The refrigerant in the crank chamber 16 is introduced into the rear area of the motor chamber 15 through the communication bore 12C and the central bore 12B of the front housing 12, and the thrust bearing 23. The refrigerant introduced into the motor chamber 15 passes the space between the stator 19 and the rotor 20. Then the refrigerant is introduced into the opening of the communication passage 40 formed in the front area of the motor chamber 15, and is introduced into the second intermediate pressure chamber 32B through the communication passage 40 and the port 35F. The refrigerant in the second intermediate pressure chamber 32B is drawn into the compression chamber 13F through the port 35C, and is further compressed by the second piston 27. Finally, the refrigerant is sent out to the external refrigerant circuit through the port 35D, the discharge chamber 33 and the outlet port 33A.

In this embodiment, in addition to the above effect (1) to (5), the following effects can be obtained.

(8) The refrigerant in the first intermediate pressure chamber 32A is introduced into the motor chamber 15 after the crank chamber 16. That is, the refrigerant in the first intermediate pressure chamber 32A is directly introduced into the crank chamber 16 before the motor chamber 15. Accordingly, since the refrigerant is low in temperature before the motor chamber 15, the crank chamber 16 can be efficiently cooled down.

(9) The refrigerant introduced from the first intermediate pressure chamber 32A flows through the crank chamber 16, the motor chamber 15 and the communication passage 40, into the second intermediate pressure chamber 32B. The communication passage 40 is formed in the convex portion protruded from the outer circumferential portion of the casing of the compressor, so the heat in the communication passage 40 is emitted to the outside of the compressor. Therefore, the refrigerant, which passes through the communication passage 40, is cooled down, and then is introduced into the second intermediate pressure chamber 32B. That is, the refrigerant, which falls in temperature and decreases its specific volume, is drawn into the second cylinder bore 13B, so the compressive efficiency can be improved.

Embodiment 4

Figure 7:
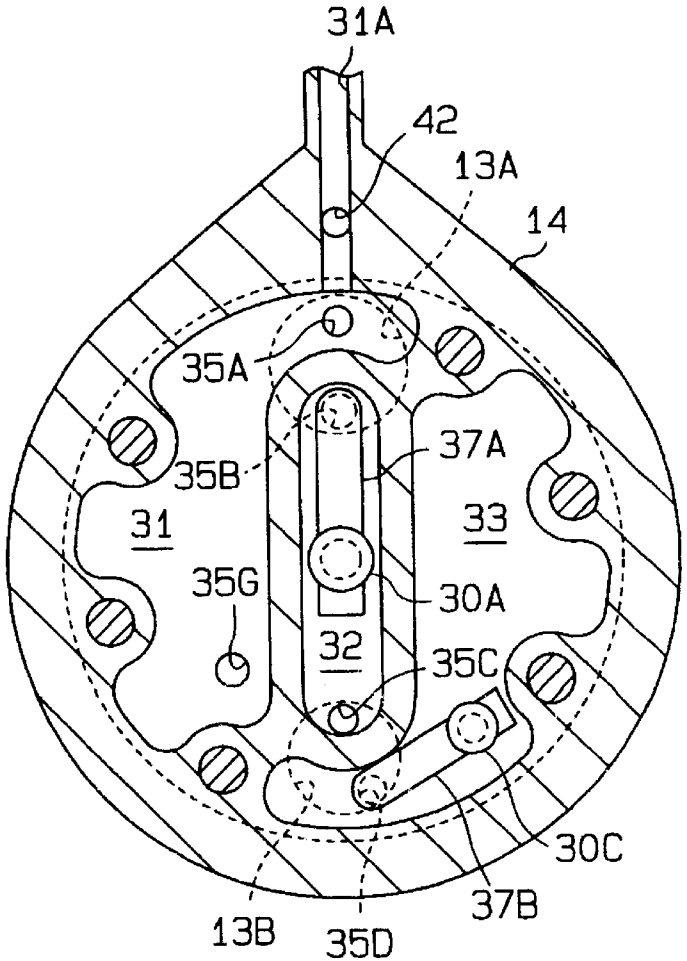
FIG. 7 is a cross-sectional view as seen from line IV—IV in FIG. 8.
Figure 8:
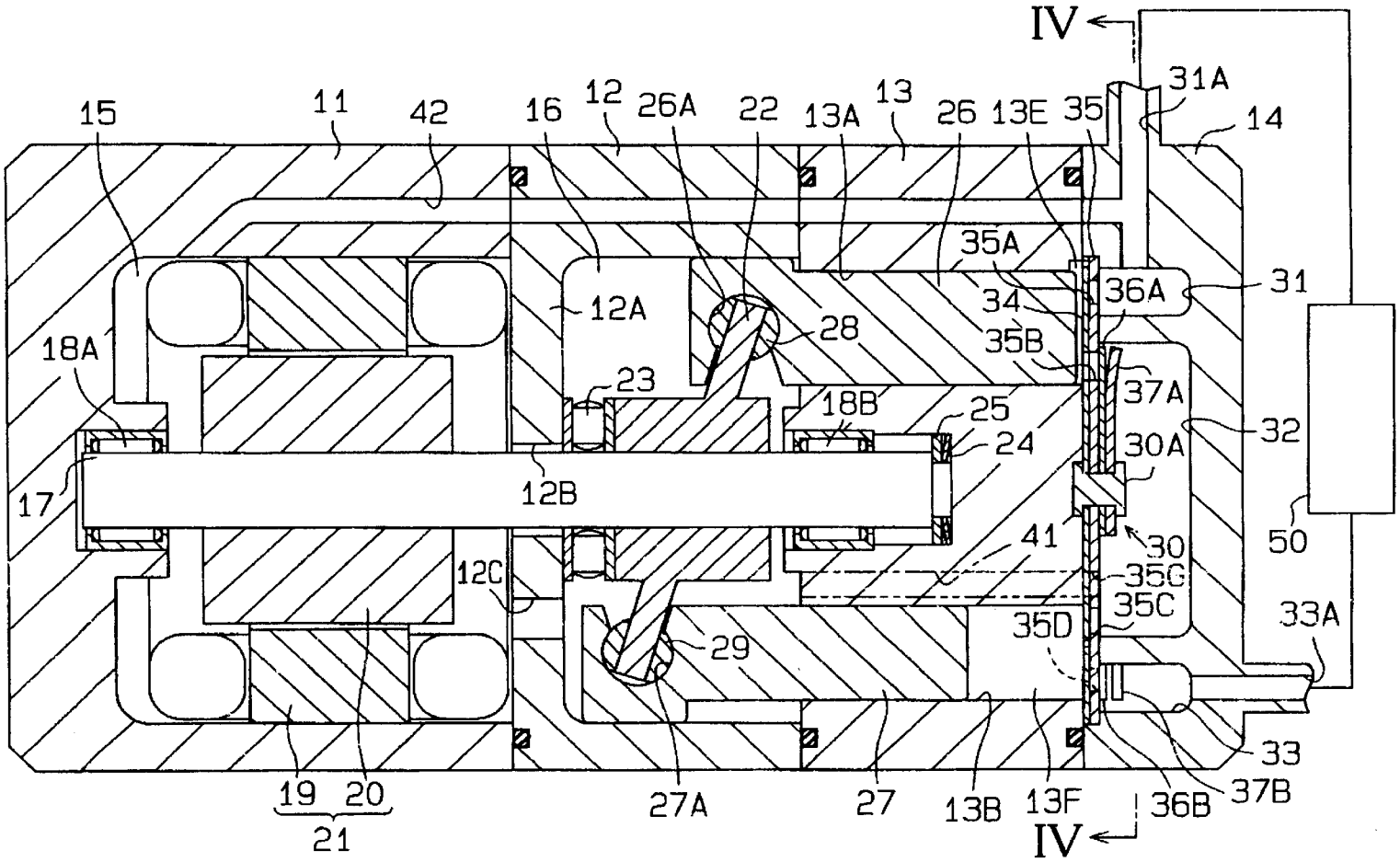
FIG. 8 is a cross-sectional view illustrating an electric type swash plate compressor according to a fourth embodiment of the present invention.

The fourth embodiment will be explained with reference to FIGS. 7 to 8. In this embodiment the arrangements of the refrigerant circuit and the communication route inside of the casing according to the first embodiment are changed. In the other points, the arrangement of the embodiment is the same as the arrangement of the first embodiment. Accordingly, the same reference numerals as the first embodiment are given to the components which are common to the first embodiment, and the overlapped description is omitted.

The ports 35A, 35B, 35C, 35D and 35G are formed in the valve plate 35. A communication passage 41 is formed to penetrate the cylinder block 13 to communicate with the port 35G. The communication passage 41 and the port 35G always communicate the suction chamber 31 with the crank chamber 16.

The front area in the motor chamber 15 always communicates with the intake port 31A through a branch communicating passage 42 branched from the intake port 31A. The branch communicating passage 42 is penetrated between the motor chamber 15 and the intake port 31A across the motor housing 11, the front housing 12, the cylinder block 13 and the rear housing 14.

The branch communicating passage 42, the bores 12B and 12C, the crank chamber 16, the communication route 41 and the port 35G constitute the communication route which always communicates the intake port 31A with the suction chamber 31 through the motor chamber 15. A part of the refrigerant circuit inside of the casing is constituted by this communication route and the motor chamber 15.

A part of the refrigerant drawn through the intake port 31A from the external refrigerant circuit 50 is directly drawn into the suction chamber 31 through the intake port 31A. The other refrigerant is introduced into the front area of the motor chamber 15 through the branch communicating passage 42. The refrigerant introduced into the motor chamber 15 passes through the space between the stator 19 and the rotor 20, and introduced into the crank chamber 16 through the communication bore 12C, the central bore 12B and the thrust bearing 23. Then the refrigerant in the crank chamber 16 is introduced into the suction chamber 31 through the communication passage 41.

In this embodiment the following effects can be obtained.

(10) The suction refrigerant is introduced into the motor chamber 15 and the crank chamber 16 before it is compressed. That is, the refrigerant in low temperature is used before the temperature rises by the compressive action. Accordingly, the motor chamber 15 and the crank chamber 16 are effectively cooled down.

(11) The branch communicating passage 42 branched from the intake port 31A is formed. A part of the refrigerant drawn from the external refrigerant circuit 50 is introduced into the suction chamber 31 through the motor chamber 15 and the crank chamber 16, and the rest of the refrigerant is directly introduced into the suction chamber 31. That is, the refrigerant of which temperature rises in both chambers 15 and 16 is only a part of the refrigerant drawn from the external refrigerant circuit 50, and the rest of the refrigerant does not rise in temperature. Accordingly, the refrigerant drawn into the compression chamber 13E is prevented from rising in temperature in some extent, so the compressive efficiency can be prevented from falling due to the increase of specific volume of the refrigerant.

(12) The suction pressure refrigerant, which is much lower in pressure than the refrigerant discharged into the discharge chamber 33 or the intermediate pressure chamber 32, is introduced into the motor chamber 15 and the crank chamber 16. Therefore, the casing of the compressor can be compact and improved about the durability.

(13) The refrigerant drawn from the branch communicating passage 42 is introduced into the crank chamber 16 after the motor chamber 15. Accordingly, the motor chamber 15 can be further efficiently cooled down by the refrigerant in low temperature, which is not passed through the crank chamber 16 relatively high in temperature.

Embodiment 5

Figure 9:
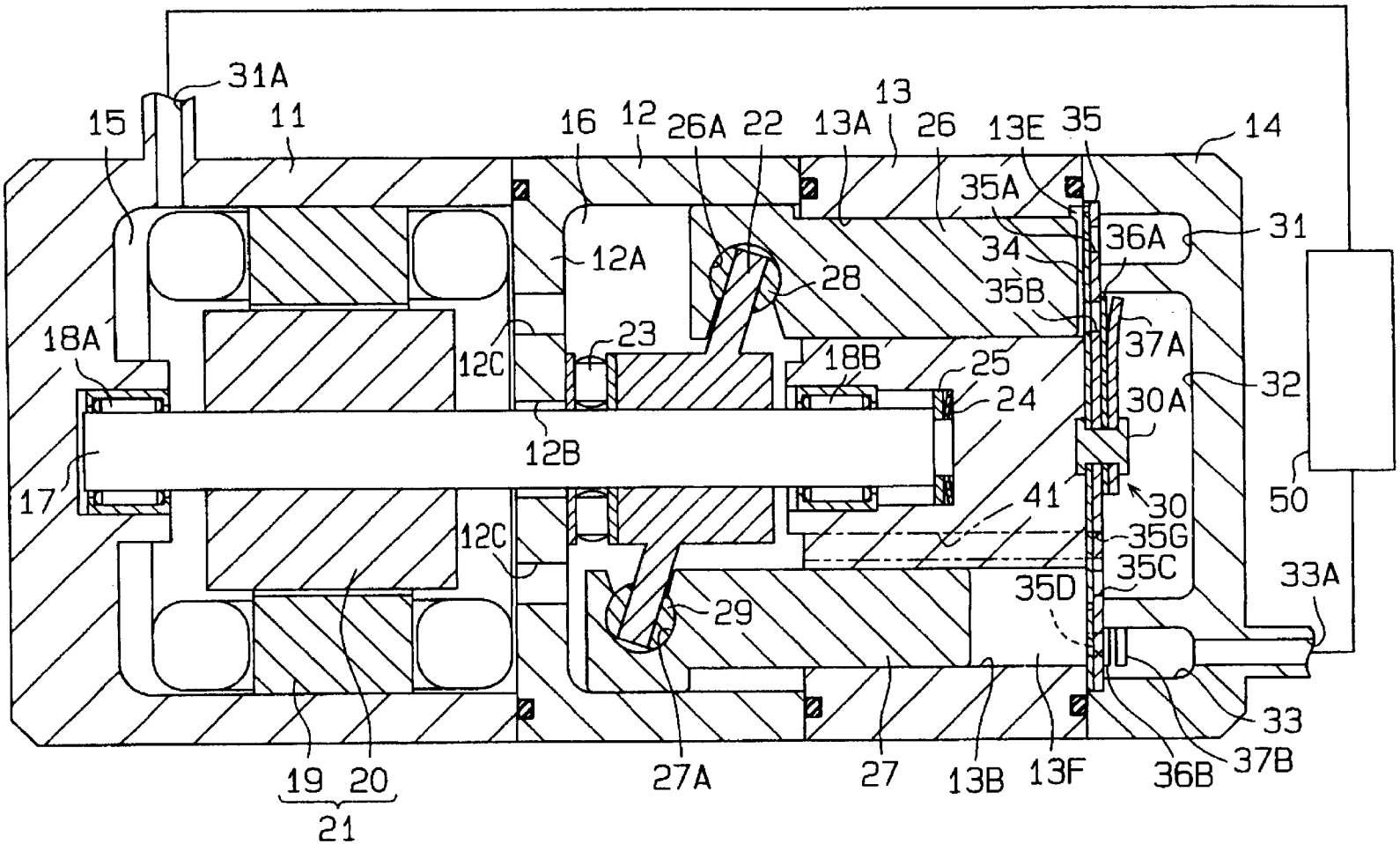
FIG. 9 is a cross-sectional view illustrating an electric type swash plate compressor according to a fifth embodiment of the present invention.

The fifth embodiment will be explained with reference to FIG. 9. In this embodiment the arrangements according to the fourth embodiment are changed in the following points. The branch communicating passage 42 is not formed but the intake port 31A is formed in the motor housing 11 so as to communicate the external refrigerant circuit with the front area of the motor chamber 15. Accordingly, the same reference numerals as the fourth embodiment are given to the components which are common to the fourth embodiment, and the overlapped description is omitted.

In this embodiment the central bore 12B, the communication bore 12C, the crank chamber 16, the communication passage 41 and the port 35G constitute the communication route which communicates the intake port 31A with the suction chamber 31. In addition to the communication route and the motor chamber 15, the intake port 31A, the suction chamber 31, the port 35A, the first cylinder bore 13A, the port 35B, the intermediate pressure chamber 32, the port 35C, the second cylinder bore 13B, the port 35D, the discharge chamber 33 and the outlet port 33A constitute the refrigerant circuit inside of the casing.

The refrigerant drawn into the intake port 31A from the external refrigerant circuit 50 is introduced into the front area of the motor chamber 15. The refrigerant introduced into the motor chamber 15 passes through the space between the stator 19 and the rotor 20, and is introduced into the crank chamber 16 through the communication bore 12C, the central bore 12B and the thrust bearing 23. Then, the refrigerant in the crank chamber 16 is introduced into the suction chamber 31 through the communication passage 41.

In this embodiment the following effects can be obtained.

(14) The intake port 31A is formed in the motor housing 11. The refrigerant introduced from the external refrigerant circuit 50 is introduced into the crank chamber 16 after the motor chamber 15. That is, the refrigerant is directly introduced into the motor chamber 15 from the external refrigerant circuit 50 through a very short route before introduced into the crank chamber 16. Accordingly, the motor chamber 15 is efficiently cooled down by the refrigerant in low temperature, which hardly has risen in temperature before introduced into the motor chamber 15.

These embodiments are not limited to be above mentioned structures, but the following embodiments also can be performed.

Not only the multistage compressor but also a single stage compressor, which compresses the refrigerant only once between the intake port and the outlet port, can be applied. In this case, the following type of the single stage compressor is given in Japanese Unexamined Patent Publication No. 11-257219. The refrigerant in the crank chamber, which is highly compressed by blow-by gas, is relieved outside the crank chamber by the pressure control valve and the pressure in the crank chamber is adjusted. Moreover, not only a fixed capacity compressor according to the publication but also a variable displacement compressor can be applied. In this case, for example, the following single stage variable displacement compressor is given. A swash plate is inclinably arranged, and the discharge capacity is adjusted by controlling the pressure in the crank chamber by opening and closing a control valve arranged in the passage which communicates the suction chamber with the crank chamber. In both type of the compressors, when the refrigerant in intermediate pressure in the crank chamber, which is lower than the discharge pressure and is higher than the suction pressure, is used by communicating the crank chamber with the motor chamber, inside of the casing of the compressor can be efficiently cooled down, and the compressor can be compact and reduced in weight.

The arrangements of the fourth embodiment and the fifth embodiment may be applied to the single stage compressor.

Other refrigerants such as ammonia can be used instead of carbon dioxide.

While in the above embodiments only a pair of two stage cylinder bores is applied, more than a pair of the cylinder bores or more than two stage cylinder bores can be applied.

Therefore the present examples and embodiments are to be considered as illustrative and not restrictive and the invention is not to be limited to the details given herein but may be modified within the scope of the appended claims.

What is claimed is:

1. An electric type swash plate compressor comprising:

an outer casing;

a motor chamber formed within said casing and accommodating a stator and a rotor;

a crank chamber formed within said casing;

a cylinder block having a plurality of cylinder bores disposed parallel to an axial center thereof;

pistons accommodated in said cylinder bores so as to be reciprocated;

a drive shaft supported in said casing so as to be rotated, inserted in said motor chamber and said crank chamber, connected to an electric motor in said motor chamber, and reciprocating said pistons through a swash plate connected to said drive shaft in said crank chamber; and a communication route introducing a refrigerant, lower in temperature than a refrigerant in a discharge chamber, into said motor chamber formed in an inner refrigerant circuit in said casing passing through said crank chamber, the refrigerant cooling said motor chamber and said crank chamber by passing through them.

2. The electric type swash plate compressor according to claim 1, wherein said compressor is a multistage type having a first cylinder bore, where the refrigerant drawn from an external refrigerant circuit is compressed, and a second cylinder bore, where the refrigerant in intermediate pressure, at least once having been compressed, is drawn and compressed, and wherein said communication route communicates an intermediate pressure chamber having the refrigerant in said intermediate pressure with said motor chamber.

3. The electric type swash plate compressor according to claim 2, wherein said communication route comprises a communication bore communicating said motor chamber with said crank chamber, and another communication bore communicating said crank chamber with said intermediate pressure chamber.

4. The electric type swash plate compressor according to claim 2, wherein said communication route introduces said refrigerant in said intermediate pressure into said motor chamber through said crank chamber.

5. The electric type swash plate compressor according to claim 1, wherein the refrigerant cools down said motor chamber and said crank chamber by passing through them.

6. The electric type swash plate compressor according to claim 1, wherein said motor chamber is arranged upstream to said crank chamber in said communication route, and wherein at least a part of the refrigerant is introduced into said crank chamber through said motor chamber.

7. The electric type swash plate compressor according to claim 1, wherein said communication route communicates either of a suction chamber having the refrigerant drawn from said external refrigerant circuit and an intake port introducing the refrigerant into said suction chamber with said motor chamber.

8. The electric type swash plate compressor according to claim 4, further comprising a branch communicating passage, wherein said passage is branched from said suction chamber or said intake port and constitutes said inner refrigerant circuit in said casing, and is arranged upstream to said motor chamber and said crank chamber.

9. The electric type swash plate compressor according to claim 1, wherein an intake port is formed in said motor chamber, whereby the refrigerant is drawn from an external refrigerant circuit into said motor chamber, and wherein said communication route communicates a suction chamber with said motor chamber to introduce the refrigerant from the motor chamber into the suction chamber.

10. An electric type swash plate compressor according to claim 1, wherein said motor chamber and said crank chamber are arranged in a row in the direction of an axis of said drive shaft, and wherein said drive shaft extends in said motor chamber and said crank chamber.

11. A multistage electric type swash plate compressor comprising:

an outer casing;

a motor chamber formed within said casing;

a crank chamber formed within said casing;

a cylinder block having a first cylinder bore, where the refrigerant drawn from an external refrigerant circuit is compressed, and a second cylinder bore, where the refrigerant in intermediate pressure, at least once having been compressed, is drawn and compressed, said first cylinder bore and said second cylinder bore being disposed parallel to an axial center of said cylinder block;

pistons accommodated in said cylinder bores so as to be reciprocated;

a drive shaft supported in said casing so as to be rotated, inserted in said motor chamber and said crank chamber, connected to an electric motor in said motor chamber, and reciprocating said pistons through a swash plate connected to said drive shaft in said crank chamber; and a communication route introducing a refrigerant in lower temperature than a refrigerant in a discharge chamber into said motor chamber formed in an inner refrigerant circuit in said casing passing through said crank chamber, wherein said communication route communicates an intermediate pressure chamber having the refrigerant in said intermediate pressure with said motor chamber, and wherein said communication route comprises a communication bore communicating said motor chamber with said crank chamber, and another communication bore communicating said crank chamber with said intermediate pressure chamber.

12. An electric type swash plate compressor comprising:

an outer casing;

a motor chamber formed within said casing;

a crank chamber formed within said casing;

a cylinder block having a plurality of cylinder bores disposed parallel to an axial center thereof;

pistons accommodated in said cylinder bores so as to be reciprocated;

a drive shaft supported in said casing so as to be rotated, inserted in said motor chamber and said crank chamber, connected to an electric motor in said motor chamber, and reciprocating said pistons through a swash plate connected to said drive shaft in said crank chamber; and a communication route introducing a refrigerant, lower in temperature than a refrigerant in a discharge chamber, into said motor chamber formed in an inner refrigerant circuit in said casing passing through said crank chamber, wherein said motor chamber is arranged upstream to said crank chamber in said communication route, and wherein at least a part of the refrigerant is introduced into said crank chamber through said motor chamber, the refrigerant cooling said motor chamber and said crank chamber by passing through them.

13. An electric type swash plate compressor comprising:

an outer casing;

a motor chamber formed within said casing;

a crank chamber formed within said casing;

a cylinder block having a plurality of cylinder bores disposed parallel to an axial center thereof;

pistons accommodated in said cylinder bores so as to be reciprocated;

a drive shaft supported in said casing so as to be rotated, inserted in said motor chamber and said crank chamber, connected to an electric motor in said motor chamber, and reciprocating said pistons through a swash plate connected to said drive shaft in said crank chamber; and a communication route introducing a refrigerant, lower in temperature than a refrigerant in a discharge chamber, into said motor chamber formed in an inner refrigerant circuit in said casing passing through said crank chamber, wherein said communication route communicates either of a suction chamber having the refrigerant drawn from said external refrigerant circuit and an intake port introducing the refrigerant into said suction chamber with said motor chamber, the refrigerant cooling said motor chamber and said crank chamber by passing through them.

* * * * *

UNITED STATES PATENT AND TRADEMARK OFFICE

CERTIFICATE OF CORRECTION

PATENT NO. : 6,565,329 B2
DATED : May 20, 2003
INVENTOR(S) : Yokomachi et al.

It is certified that error appears in the above-identified patent and that said Letters Patent is hereby corrected as shown below:

Column 4,
Lines 65-66, following "… of the rear housing 14, are defined." please insert the following as a new and separate paragraph:

-- The valve plate assembly 30 comprises a suction valve disk 34, a valve plate 35, first and second discharge valves 36A and 36B, first and second retainers 37A and 37B, pins 30A and 30C. --

Signed and Sealed this

Twenty-eighth Day of October, 2003

JAMES E. ROGAN
*Director of the United States Patent and Trademark Office*